US006584635B1

(12) United States Patent
Kornegay

(10) Patent No.: US 6,584,635 B1
(45) Date of Patent: Jul. 1, 2003

(54) ROTATING SPONGE AND SPOUT SYSTEM WITH SHOWER COUPLING

(76) Inventor: Lemuel F. Kornegay, 7716 Grand Blvd., Port Richey, FL (US) 34668

( * ) Notice: Subject to any disclaimer, the term of this patent is extended or adjusted under 35 U.S.C. 154(b) by 317 days.

(21) Appl. No.: 09/699,592

(22) Filed: Oct. 30, 2000

(51) Int. Cl.[7] ..... G03D 5/06

(52) U.S. Cl. ..... 15/97.1; 15/24; 15/29.1; 4/606

(58) Field of Search ..... 15/24, 29, 97.1; 4/606; 401/203, 204, 289

(56) References Cited

U.S. PATENT DOCUMENTS 4,370,771 A * 2/1983 Gonzalvo ..... 15/29
4,461,052 A * 7/1984 Mostul ..... 15/29
5,619,766 A * 4/1997 Zhadanov et al. ..... 15/29
6,021,539 A * 2/2000 Zhadanov et al. ..... 15/29
6,151,728 A * 11/2000 Wright et al. ..... 4/606

* cited by examiner

*Primary Examiner*—Robert J. Warden, Sr.
*Assistant Examiner*—Laura C Cole
(74) *Attorney, Agent, or Firm*—Edward P. Dutkiewicz

(57) ABSTRACT

A shower accessory system comprises a housing having a central component with a sidewall formed with a central chamber having an input region and an output region. The central component has a circular upper opening in the top and a circular lower opening in the bottom. A water wheel is mounted in the upper opening for rotation and for being propelled by a flow of water through the central component. An upper component of the housing has a sidewall with an upper opening and a lid removably coupled to the sidewall to form an upper chamber. The upper chamber has a central gear coupled to the water wheel with a common axis for rotation therewith. A lower component of the housing has a sidewall and an open bottom and a sponge mounted therein. A spindle couples the sponge holder and the water wheel for rotating the sponge upon rotation of the water wheel about a common axis.

6 Claims, 4 Drawing Sheets

FIG 2
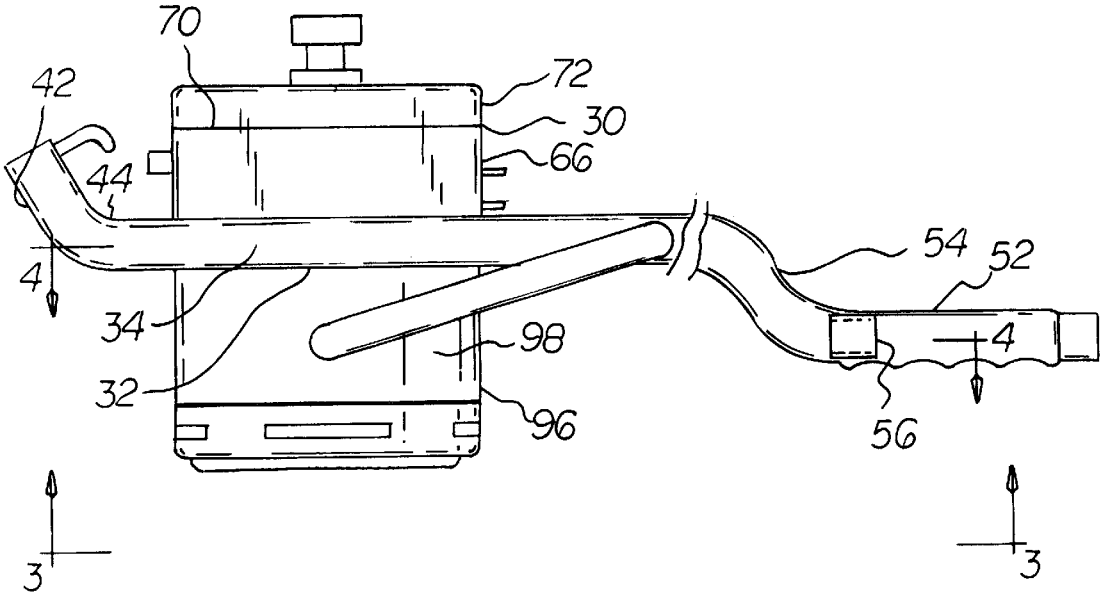
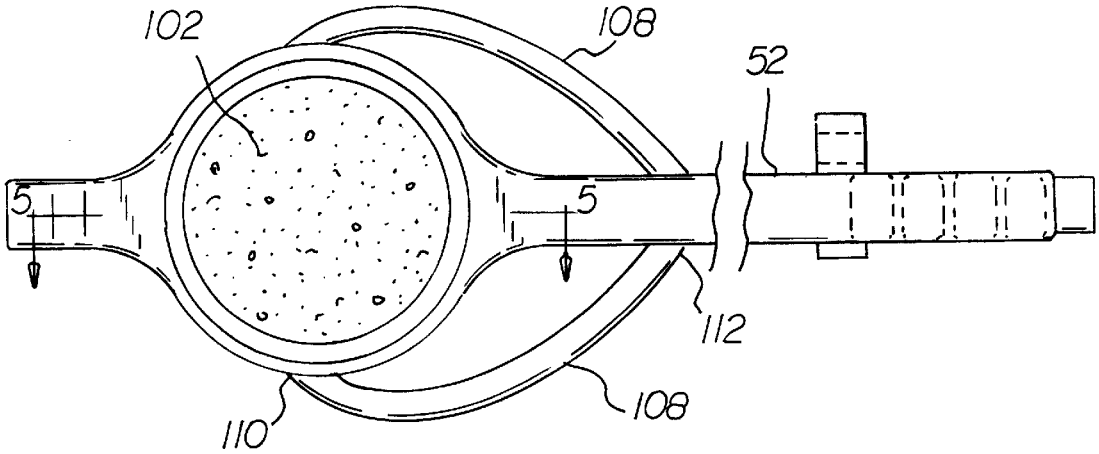
FIG 3

FIG 4
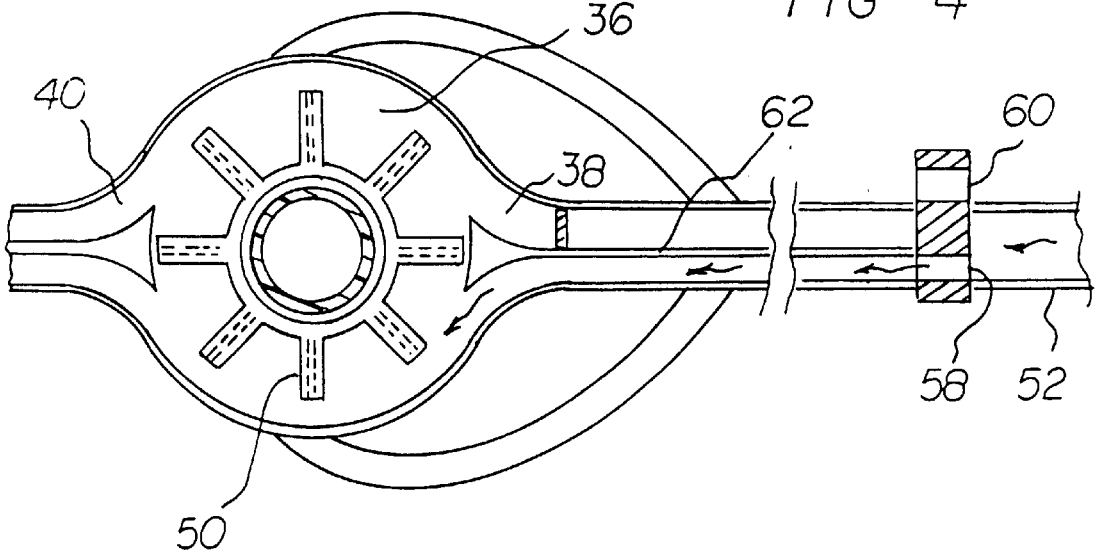
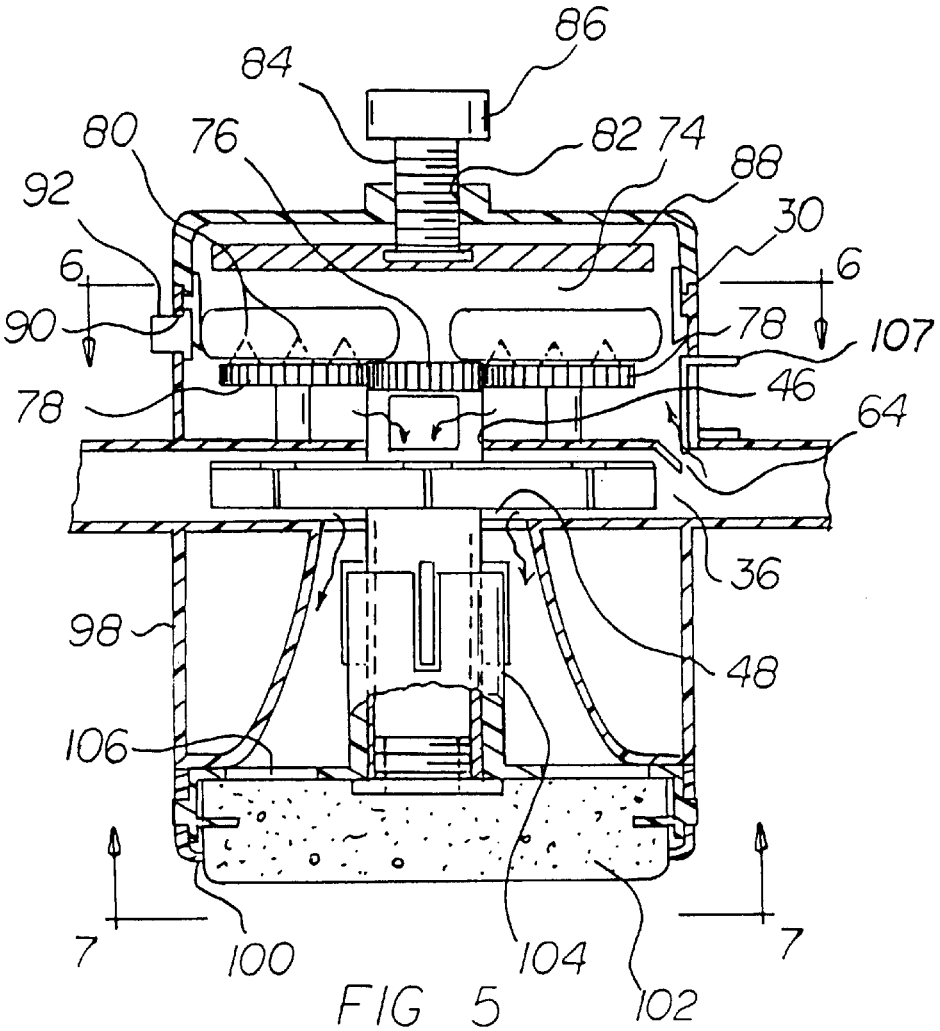
FIG 5

FIG 6
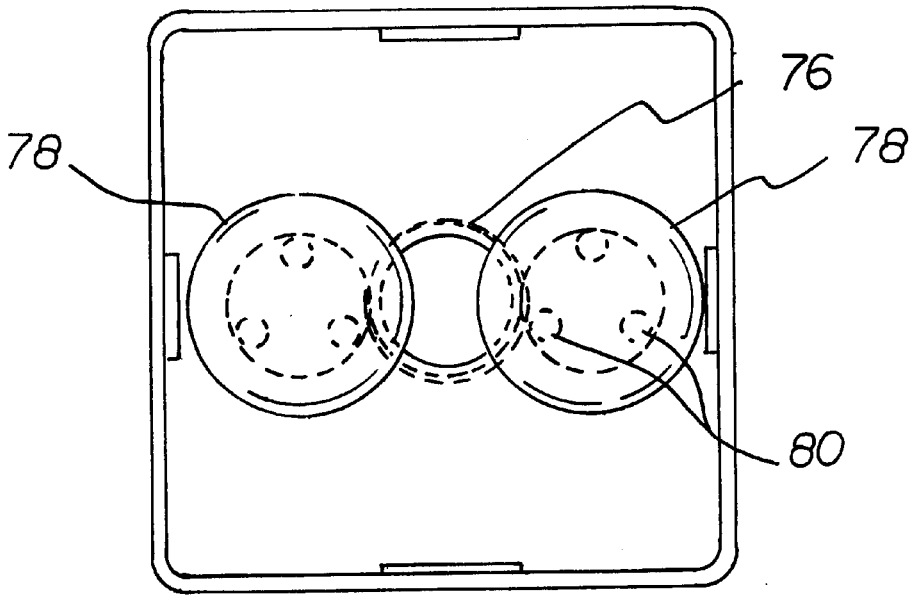
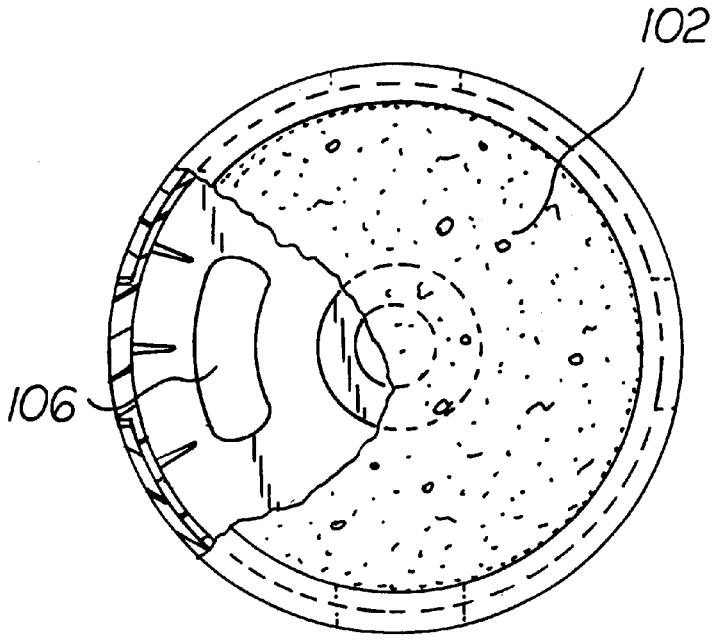
FIG 7

ROTATING SPONGE AND SPOUT SYSTEM WITH SHOWER COUPLING

BACKGROUND OF THE INVENTION

1. Field of the Invention

The present invention relates to a shower accessory system and more particularly pertains to dispensing soapy water through a sponge while showering for increased cleanliness and convenience.

2. Description of the Prior Art

The use of shower and bathing aides of known designs and configurations is known in the prior art. More specifically, shower and bathing aides of known designs and configurations previously devised and utilized for the purpose of dispensing water for showers, baths, and the like through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,089,079 to Nicholson discloses a rotary washing brush device. U.S. Pat. No. 4,282,623 to Gacuzana discloses a fluid powered brush. U.S. Pat. No. 5,153,962 to Ritter discloses a fluid powered brush. U.S. Pat. No. 5,649,334 to Henriquez, et al discloses a water and soap dispensing scrubber apparatus. Lastly, U.S. Pat. No. 5,911,256 to Tsai discloses a brush having a bristled head capable of being powered by water to swivel.

While these devices fulfill their respective, particular objectives and requirements, the aforementioned patents do not describe a shower accessory system that allows dispensing soapy water through a sponge while showering for increased cleanliness and convenience.

In this respect, the shower accessory system according to the present invention substantially departs from the conventional concepts and designs of the prior art, and in doing so provides an apparatus primarily developed for the purpose of dispensing soapy water through a sponge while showering for increased cleanliness and convenience.

Therefore, it can be appreciated that there exists a continuing need for a new and improved shower accessory system which can be used for dispensing soapy water through a sponge while showering for increased cleanliness and convenience. In this regard, the present invention substantially fulfills this need.

SUMMARY OF THE INVENTION

In view of the foregoing disadvantages inherent in the known types of shower and bathing aides of known designs and configurations now present in the prior art, the present invention provides an improved shower accessory system. As such, the general purpose of the present invention, which will be described subsequently in greater detail, is to provide a new and improved shower accessory system and method which has all the advantages of the prior art and none of the disadvantages.

To attain this, the present invention essentially comprises a shower accessory system for dispensing soapy water through a sponge while showering for increased cleanliness and convenience. First provided as part of the system is a coupler. The coupler is formed in a hollow generally hemispherically shaped configuration. The coupler is adapted to be removably coupled to a shower head. The coupler has a large opening to receive water from the shower head and a small opening to dispense water from the coupler. Next provided is a flexible tube. The flexible tube is of an extended length. An input end of the flexible tube is coupled to the small opening of the coupler. An output end of the flexible tube is also provided. The flexible tube is adapted to convey water through the tube from the input end to the output end along a path of travel. Next provided is a housing. The housing has a central component with a sidewall in a generally cylindrical configuration. The central component is formed with a central chamber. The central chamber has an input region coupled to the outlet of the tube. The central chamber also has an output region. The output region is in the shape of a spout with an upturned bend adjacent to its midpoint. The central component has a circular upper opening in the top and a circular lower opening in the bottom. The central component also has a water wheel mounted in the upper opening for rotation about an axis perpendicular to the path of travel of the water and for being propelled by a flow of water through the central component. The central component also has a rigid handle between the sidewall and the tube. A bend is formed in the handle adjacent to the midpoint of the handle. A slide valve is provided. The slide valve extends through and across the handle adjacent to the midpoint of the handle. First and second apertures are provided through the slide valve. The handle has a vertical divider between the valve and the water wheel to selectively direct water to one side of the water wheel or the other for thereby allowing the water wheel to change its direction of rotation. Next provided is an upper component of the housing. The upper component has a sidewall in a generally rectilinear configuration. The upper component has an upper opening. A lid is provided. The lid is removably coupled to the sidewall to form an upper chamber. The upper chamber has a central gear coupled to the water wheel with a common axis for rotation with the water wheel. The upper chamber has two laterally disposed support gears mated for rotation in response to the rotation of the central gear. The lid has a central threaded aperture. A bolt is provided through the central threaded aperture. The bolt has an operator controlled knob above and a plate there beneath for selectively applying pressure to the bars of soap. The sidewalls also have a port. The primary use is for liquid soap injection with a window as a secondary use for viewing a bar soap. Next provided is a lower component of the housing. The lower component of the housing has a sidewall in a generally cylindrical configuration with a diameter slightly less than that of the central component. The lower component has an open bottom. A sponge is next provided. The sponge is mounted within the lower component. A spindle couples the sponge and the water wheel about a common axis. Lastly, a pair of handles is provided. Each handle has an arcuate configuration. The handles are attached at first ends to the sidewall of the lower component at diametrically opposed locations. Second ends of the handles extend for ease of manipulation of the system by a user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shower accessory system which has all of the advantages of the prior art shower and bathing aides of known designs and configurations and none of the disadvantages.

It is another object of the present invention to provide a new and improved shower accessory system which may be easily and efficiently manufactured and marketed.

It is further object of the present invention to provide a new and improved shower accessory system which is of durable and reliable constructions.

An even further object of the present invention is to provide a new and improved shower accessory system which is susceptible of a low cost of manufacture with regard to both materials and labor, and which accordingly is then susceptible of low prices of sale to the consuming public, thereby making such shower accessory system economically available to the buying public.

Even still another object of the present invention is to provide a shower accessory system for dispensing soapy water through a sponge while showering for increased cleanliness and convenience.

Lastly, it is an object of the present invention to provide a new and improved shower accessory system comprising a housing having a central component with a sidewall formed with a central chamber having an input region and an output region. The central component has a circular upper opening in the top and a circular lower opening in the bottom. A water wheel is mounted in the upper opening for rotation and for being propelled by a flow of water through the central component. An upper component of the housing has a sidewall with an upper opening and a lid removably coupled to the sidewall to form an upper chamber. The upper chamber has a central gear coupled to the water wheel with a common axis for rotation therewith. A lower component of the housing has a sidewall and an open bottom and a sponge mounted therein. A spindle couples the sponge and the water wheel about a common axis.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevational view of the housing and handle shown in FIG. 1.

FIG. 3 is a bottom elevational view of the housing taken along line 3—3 of FIG. 2.

FIG. 4 is a cross-sectional view taken along line 4—4 of FIG. 2.

FIG. 5 is a cross-sectional view of the housing taken along line 5—5 of FIG. 3.

FIG. 6 is a top elevational view of the housing with the lid removed taken along line 6—6 of FIG. 5.

FIG. 7 is a bottom elevational view of the housing taken along line 7—7 of FIG. 5.

The same reference numerals refer to the same parts throughout the various Figures.

DESCRIPTION OF THE PREFERRED EMBODIMENT

Figure 1:
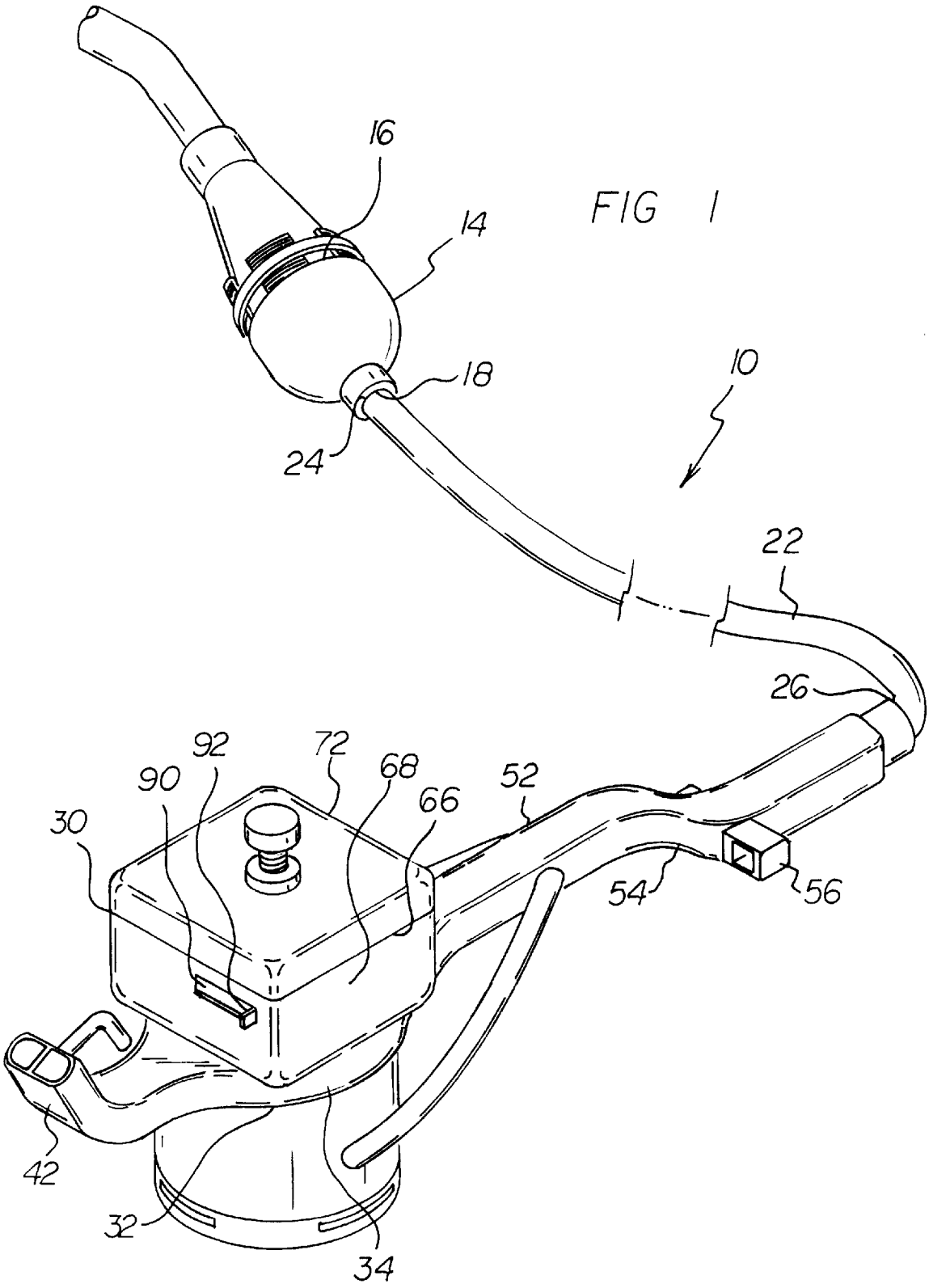
FIG. 1 is a perspective illustration of the new and improved shower accessory system constructed in accordance with the principles of the present invention.

With reference now to the drawings, and in particular to FIG. 1 thereof, the preferred embodiment of the new and improved shower accessory system embodying the principles and concepts of the present invention and generally designated by the reference numeral 10 will be described.

The present invention, the shower accessory system 10 is comprised of a plurality of components. Such components in their broadest context include a housing with a central component, an upper component and a lower component. Such components are individually configured and correlated with respect to each other so as to attain the desired objective.

First provided is a coupler 14. The coupler is formed in a hollow generally hemispherically shaped configuration. The coupler has a large opening 16 to receive water from the shower head and a small opening 18 to dispense water from the coupler.

Next provided is a flexible tube 22. The flexible tube is of an extended length. An input end 24 of the flexible tube is coupled to the small opening of the coupler. An output end 26 of the flexible tube is also provided. The flexible tube is adapted to convey water through the tube from the input end to the output end along a path of travel.

Next provided is a housing 30. The housing has a central component 32 with a sidewall 34 in a generally cylindrical configuration. The central component is formed with a central chamber 36. The central chamber has an input region 38 coupled to the outlet of the tube. The central chamber also has an output region 40. The output region is in the shape of a spout 42 with an upturned bend 44 adjacent to its midpoint. The central component has a circular upper opening 46 in the top and a circular lower opening 48 in the bottom. The central component also has a water wheel 50 mounted in the upper opening for rotation about an axis perpendicular to the path of travel of the water and for being propelled by a flow of water through the central component. The central component also has a rigid handle 52 between the sidewall and the tube. A Z-shaped bend 54 is formed in the handle adjacent to the midpoint of the handle. A slide valve 56 is provided. The slide valve extends through and across the handle adjacent to the midpoint of the handle. First and second apertures 58, 60 are provided through the slide valve. The handle has a vertical divider 62 between the valve and the water wheel to selectively direct water to one side of the water wheel or the other-for thereby allowing the Water wheel to change its direction of rotation. Water flows from the handle into an upper component for receiving soap. Water jet openings 64 are provided, one for each water chamber. A divider 62 is a vertical divider to form two separate water jet openings. Water jet shut offs 107 function as flaps for shutting off the water jets individually or together for use of strictly liquid soap.

Next provided is an upper component 66 of the housing. The upper component has a sidewall 68 in a generally rectilinear configuration. The upper component has an upper opening 70. A lid 72 is provided. The lid is removably coupled to the sidewall to form an upper chamber 74. The upper chamber has a central gear 76 coupled to the water wheel with a common axis for rotation with the water wheel. The upper chamber has two laterally disposed support gears 78 mated for rotation in response to the rotation of the central gear. Each support gear has a plurality of projections 80 for frictionally retaining solid soap discs as the support gears rotate. The support for the central gear has an aperture for passage of soapy water from the upper chamber to the intermediate chamber and then to the user. The lid has a central threaded aperture 82. A bolt 84 is provided through the central threaded aperture. The bolt has an operator controlled knob 86 above and a plate 88 there beneath for selectively applying pressure to the bars of soap. The sidewalls also have a port 90. A liquid injection port 92 is provided to selectively open and close the port for viewing of the soap at the discretion of a user. The use of liquid soap instead of bar soap is preferred.

Next provided is a lower component 96 of the housing. The lower component of the housing has a sidewall 98 in a generally cylindrical configuration with a diameter slightly less than that of the central component. The lower component has an open bottom 100. A sponge 102 is next provided. The sponge is mounted within the lower component. A spindle 104 couples the sponge and the water wheel for rotating the sponge upon rotation of the water wheel about a common axis. The spindle has threadedly coupled upper and lower components. An opening 106 in a bearing plate allows the soaps water to enter the sponge.

Lastly, a pair of handles 108 is provided. Each handle has an arcuate configuration. The handles are attached at first ends 110 to the sidewall of the lower component at diametrically opposed locations. Second ends 112 of the handles extend for ease of manipulation of the system by a user.

As to the manner of usage and operation of the present invention, the same should be apparent from the above description.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A shower accessory system for dispensing soapy water through a sponge while showering for increased cleanliness and convenience comprising, in combination:

a coupler formed in a hollow generally hemispherically shaped configuration adapted-to be removably coupled to a shower head, the coupler having a opening to receive water from the shower head and a opening to dispense water therefrom;

a flexible tube of an extended length with an input end coupled to the opening of the coupler and an output end adapted to convey water there through from the input end to the output end along a path of travel;

a housing having a central component with a sidewall in a generally cylindrical configuration, the central component being formed with a central chamber having an input region coupled to the output end of the tube and an output region in the shape of a spout with an upturned bend adjacent to its midpoint, the central component having a circular upper opening in the top and a circular lower opening in the bottom with a water wheel mounted in the upper openings for rotation about an axis perpendicular to the path of travel of the water and for being propelled by a flow of water through the central component, the central component also having a rigid handle between the sidewall and the tube with a Z-shaped bend adjacent to its midpoint, a slide valve extending through and across the handle adjacent to the midpoint with a first and second aperture there through, the handle having a vertical divider between the valve and the water wheel to selectively direct water to one side of the water wheel or the other for thereby allowing the water wheel to change its direction of rotation;

an upper component of the housing having a sidewall in a generally rectilinear configuration with an upper opening and with a lid removably coupled thereto to form an upper chamber, the upper chamber having a central gear coupled to the water wheel with a common axis for rotation therewith, the upper chamber having two laterally disposed support gears mated for rotation in response to the rotation of the central gear, the support gears having upstanding projections for receiving and maintaining bars of soap thereon, the lid having a central threaded aperture with a bolt there through, the bolt having an operator controlled knob above and a plate there beneath for selectively applying pressure to the bars of soap, the sidewalls also having a port with a liquid soap injection port to selectively open and close the port at the discretion of a user;

a lower component of the housing with a sidewall in a generally cylindrical configuration with a diameter slightly less than that of the central component and with an open bottom and a sponge mounted therein, a spindle coupling the sponge and the water wheel about a common axis; and a pair of handles, each with an arcuate configuration attached at first ends to the sidewall of the lower component at diametrically opposed locations and extending second ends for ease of manipulation of the system by a user.

2. A shower accessory system comprising:

a housing having a central component with a sidewall formed with a central chamber having an input region and an output region, the central component having a circular upper opening in the top and a circular lower opening in the bottom with a water wheel mounted in the upper opening for rotation and for being propelled by a flow of water through the central component;

an upper component of the housing having a sidewall with an upper opening and with a lid removably coupled thereto to form an upper chamber, the upper chamber having a central gear coupled to the water wheel with a common axis for rotation therewith; and a lower component of the housing with a sidewall and with an open bottom and a sponge mounted therein, a spindle coupling the sponge and the water wheel about a common axis.

3. The system as set forth in claim 2 wherein the central component has a rigid handle between the sidewall and a tube with a Z-shaped bend adjacent to its midpoint, a slide valve extending through and across the handle adjacent to the midpoint with a first and second aperture there through, the handle having a vertical divider between the valve and the water wheel to selectively direct water to one side of the water wheel or the other for thereby allowing the water wheel to change its direction of rotation.

4. The system as set forth in claim 2 wherein the lid has a central threaded aperture with a bolt there through, the bolt having an operator controlled knob above and a plate there beneath for selectively applying pressure to the bars of soap, the sidewalls also having a port with a liquid soap injection port to selectively open and close the port at the discretion of a user.

5. The system as set forth in claim 2 and further including a pair of handles, each with an arcuate configuration attached at first ends to the sidewall of the lower component at diametrically opposed locations on the handle.

6. The system as set forth in claim 2 and further including shut off flaps positionable between an open position for allowing water to enter the upper chamber through a water injecting chamber jets whereby injected water allows a bar soap to achieve a lathering as it wets the bar soap in conjunction with soap disc rotation to create soapy water that flows into openings below the upper chamber gear down through the hollow axis and into the sponges.

* * * * *